United States Patent [19]

Pao

[11] 4,137,926

[45] Feb. 6, 1979

[54] PORTABLE BATTERY OPERATED MANICURE DEVICES

[76] Inventor: Cohon Pao, 2, Hoi Ping Rd., 1st. Floor, Hong Kong, Hong Kong

[21] Appl. No.: 791,992

[22] Filed: Apr. 28, 1977

[30] Foreign Application Priority Data

Oct. 22, 1976 [GB] United Kingdom ..... 44027/76

[51] Int. Cl.[2] ..... A45D 29/05

[52] U.S. Cl. ..... 132/73.6

[58] Field of Search ..... 132/75.8, 76.4, 76.5, 132/73.6; 310/50; 15/23; 128/522; 24/3 K

[56] References Cited

U.S. PATENT DOCUMENTS

| | | | |
|---|---|---|---|
| 1,719,064 | 7/1929 | Lidseen | 132/73.6 |
| 3,216,034 | 11/1965 | Johnson | 15/23 |
| 3,240,966 | 3/1966 | Thompson | 310/50 |
| 3,563,252 | 2/1971 | Spohr | 132/73.6 |
| 3,613,696 | 10/1971 | Paule | 132/73.6 |

*Primary Examiner*—G. E. McNeill

*Attorney, Agent, or Firm*—Prutzman, Kalb, Chilton & Alix

[57] ABSTRACT

A portable battery operated manicure device comprises a casing containing a motor and adapted to receive one or more batteries. The motor is connected to a switch which can disconnect it or connect it directly or via a resistor to the battery or batteries to provide fast and slow speeds. An axial motor shaft extends through the casing and friction mounts an abrasive disc surrounded by a sleeve secured to the casing.

5 Claims, 5 Drawing Figures

PORTABLE BATTERY OPERATED MANICURE DEVICES

BACKGROUND OF THE INVENTION

1. Field of the Invention

The present invention relates to portable battery operated manicure devices. Such manicure devices are similar to our battery operated erasers which are the subject of British Pat. Nos. 1,215,287 and 1,341,811.

2. Summary of the Invention

According to the present invention there is provided a portable battery operated manicure device comprising a casing having a space therein for at least one electric battery, a motor arranged within the casing, and means including connection means, a resistor, and an electrical switch for making electrical connections between the at least one battery and the motor selectively directly or via the resistor for switching on fast speed, on slow speed, or off, the motor including a shaft which extends axially of the motor through the casing, an abrasive disc being mounted by friction on one end of the shaft externally of the casing and first sleeve means being secured to the casing surrounding the abrasive disc.

Preferably the sleeve means is detachable and the abrasive disc is replaceable.

Advantageously the casing comprises a motor-encasing part, a first battery-encasing part formed as an outer sleeve of which one end is attached to the motor-encasing part and of which an opposite end is open, and a second battery-encasing part comprising an inner sleeve and an end wall, the end wall being attached to an outer end of the inner sleeve and the inner sleeve being removably received within the outer sleeve.

There may be provided a cylindrical abrasive-stone with holder and a centrifugal fan, both mounted by friction on the other end of the shaft, and second sleeve means secured to the casing and surrounding at least the centrifugal fan and part of the cylindrical abrasive-stone with holder, the second sleeve means having aperture means therein adjacent the fan for outflow of air, whereby the fan and second sleeve means in combination produce a flow of air for drying nail-enamel coated on a nail. The second sleeve means may include a wide portion surrounding the centrifugal fan as a fan-casing and a narrow portion surrounding the at least part of the cylindrical abrasive-stone with holder, the second sleeve means being detachable from the casing. The cylindrical abrasive-stone with holder may be displaced by a polishing means comprising a polishing head and a holder, the polishing head being detachable and replaceable. The cylindrical abrasive-stone with holder may be displaced by a small notched disc for removing cuticle of nails, the notched disc being detachable and replaceable.

DESCRIPTION OF THE PREFERRED EMBODIMENT

Figure 1:
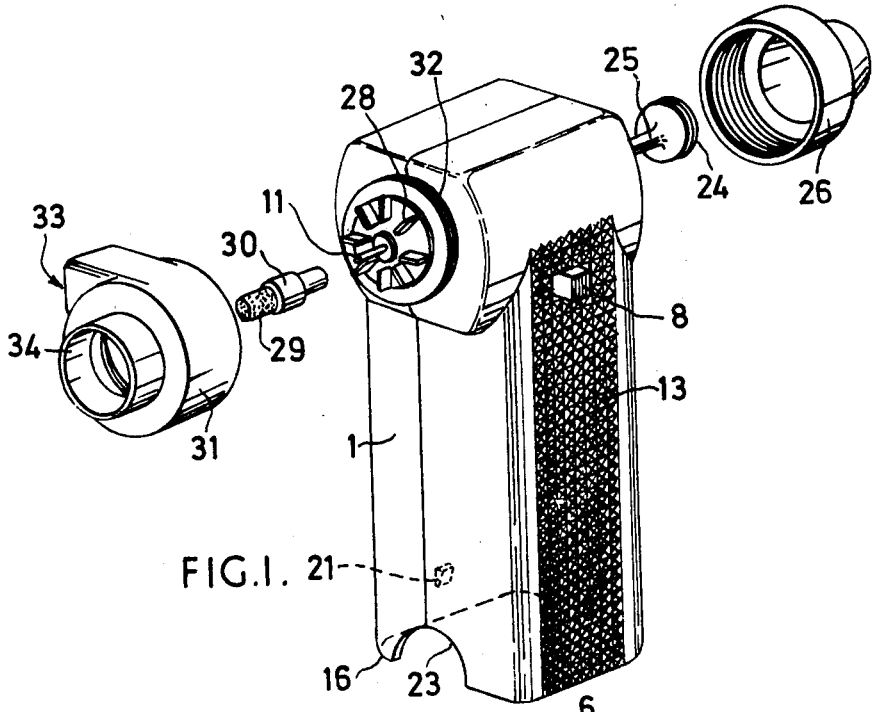
FIG. 1 is a perspective partially exploded view of a preferred manicure device.
Figure 2:
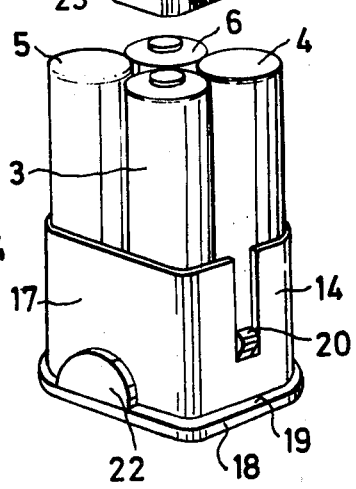
FIG. 2 is a cross-sectional view of the device of FIG. 1.

The preferred battery operated portable manicure device comprises a casing 1 having a space 2 therein for four electric batteries 3, 4, 5, and 6; a motor 7 arranged within the casing 1; means including an electrical switch 8, a resistor (not shown), an upper group of four contacts 9, and a lower group of four contacts 10 for making electrical connections between the four batteries 3 to 6 (in series) and the motor 7 and for switching the motor on and off and, in the on position, for selecting the motor speed as fast or slow. The motor 7 includes a shaft 11 which extends axially of the motor 7 through the casing 1.

The casing 1 comprises a motor-encasing part 12, a first battery-encasing part 13 and a second battery-encasing part 14. The first battery-encasing part 13 is formed as an outer sleeve of which one end 15 is attached to the motor-encasing part 12 and of which an opposite end 16 is open. The second battery-encasing part 14 comprises an inner sleeve 17 and an end wall 18. The end wall 18 is attached to an outer end 19 of the inner sleeve 17. The inner sleeve 17 is removably received within the outer sleeve 13 and is retained by means of two projections on opposite sides of the sleeve 17, (one projection being shown at 20), engaging corresponding recesses such as recess 21. The second battery-encasing part 14 includes two segmentally shaped portions such as portion 22 which enter cut-outs such as cut-out 23 in the first battery-encasing part 13 for gripping of part 14 and withdrawing it from part 13.

The motor shaft 11, which extends axially of the motor 7 and through the casing 1, carries at one of its ends an abrasive disc comprising an abrasive pad 24 mounted on the face of a disc-shaped portion of a holder 25, which is mounted by friction on the shaft 7. A first sleeve 26 is secured to the casing 1 by means of a screwthread which cooperates with a threaded mounting 27 on the casing.

A centrifugal fan 28 and a cylindrical abrasive-stone 29 with holder 30 are mounted by friction on the other end of the shaft externally of the casing 1, with the centrifugal fan being arranged between the abrasive-stone with holder and the casing. A second sleeve 31 is secured to the casing by means of a screwthread cooperating with a further screw-threaded portion 32 integral with the casing 1. The second sleeve 31 surrounds the centrifugal fan 28 and partly surrounds the cylindrical abrasive-stone 29 with holder 30. An aperture 33 in the second sleeve 31 directs the outflow of air from the centrifugal fan when in operation. The portion 34 of the second sleeve 31 surrounding at least partly the abrasive-stone and holder is of reduced diameter with respect to the portion surrounding the centrifugal fan 28.

The cylindrical abrasive-stone 29 with holder 30 may be removed from the other end of the motor shaft 11 and, in its place, a polishing head 35 with holder 36 may be friction-attached to the shaft. Alternatively, a small notched disc 37 having a tubular attachment portion 38 may be attached to the other end of the shaft 11, the cylindrical portion 38 being a friction fit on the shaft.

Figure 5:
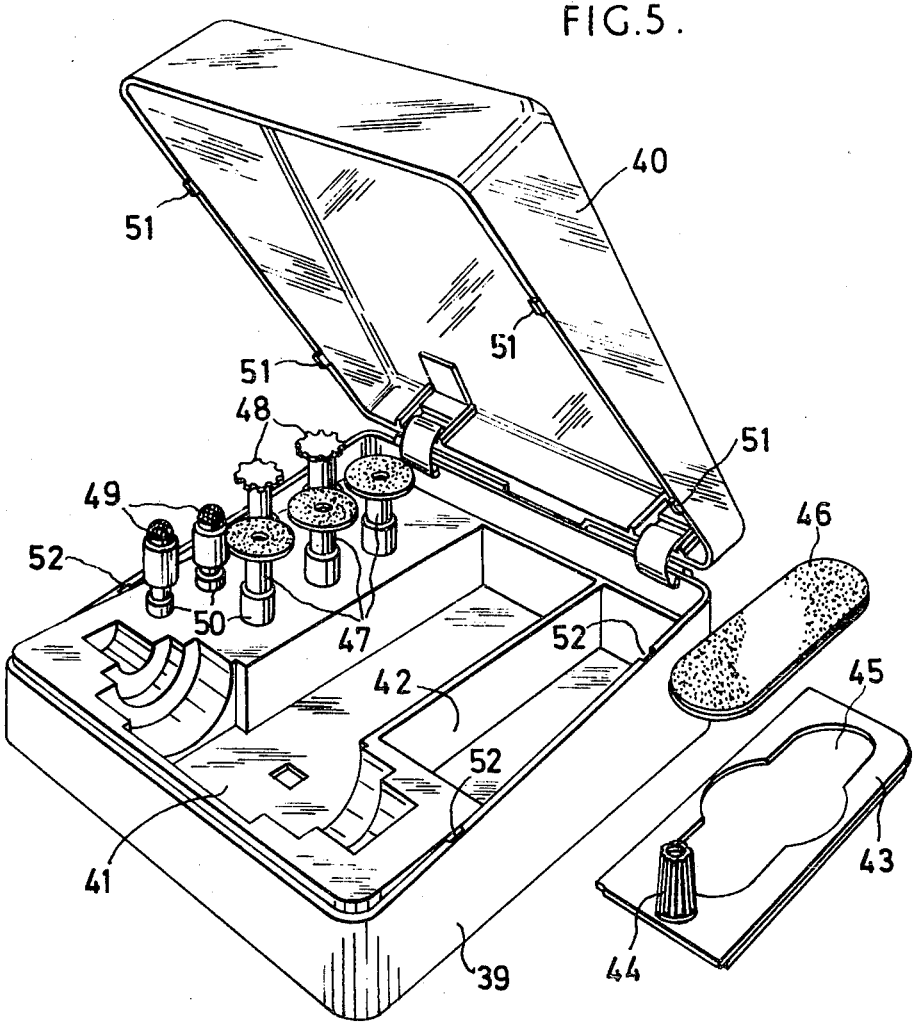
FIG. 5 shows a kit of accessories for the device of FIG. 1.

The preferred manicure device may be supplied with a kit of accessories such as that shown in FIG. 5. The kit comprises a plastic case 39 on which is hinged a clear plastics cover 40. The case has a recess generally shown at 41 shaped for receiving the manicure device and a small enclosed box 42 coverable by a lid 43 with a handle 44 for holding, for instance, replacement abrasive-discs or polishing heads. The lid 43 has a recess 45 for receiving, for instance, a hand file 46. Three replacement abrasive discs 47, two replacement notched discs 48, and two replacement polishing means 49 are shown retained for the purpose of display in cylindrical protrusions 50 which are formed integrally with the case 39. Four plastics tabs 51 formed integrally with the lid 40 are arranged to cooperate with openings 52 formed in the rim of the case 39 so as to clamp the lid to the case for the purpose of closing it.

In use, the preferred manicuring device is switched on by means of the switch 8, which has two "on" positions for slow and fast rotation of the shaft 11 respectively. Trimming or filing of a fingernail may then be accomplished by gently touching the face of the abrasive disc with the part of the nail to be trimmed or filed. The first sleeve 26 serves to support the finger and to protect the skin thereof from abrasion by the disc 24. The cylindrical abrasive-stone 29 may also be used for filing nails by sliding the nail thereagainst and using the second sleeve 31 for support of the finger. Because the diameter of the cylindrical abrasive-stone is relatively small, its circumferential speed is relatively low so that accidental contact with skin of the finger does not cause damage or pain. The cylindrical abrasive-stone is made from, for instance, oil stone and will therefore hardly wear during use.

In order to enhance the drying of nail enamel or varnish, a treated nail may be held in the path of the air flow through the aperture 33 in the second sleeve 31. The fingernail should be moved gently to achieve uniform drying.

Figure 4:
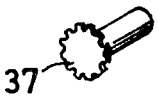
FIG. 4 shows a cuticle-removing attachment for use with the device of FIG. 1.

For the purpose of removing cuticle from a fingernail, the cylindrical abrasive-stone may be replaced by the small notched disc 37 shown in FIG. 4. The cuticle should preferably be softened by immersion in water for approximately 5 minutes, after which the rotating notched disc may be placed on the base and sides of the fingernail so as to remove the cuticle.

Figure 3:
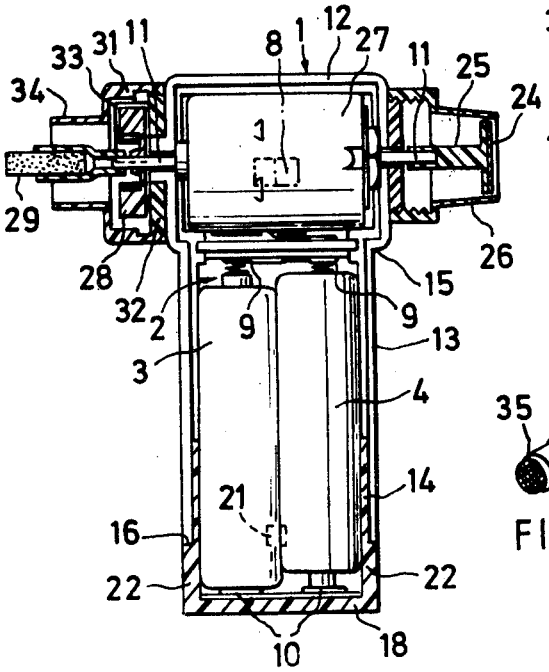
FIG. 3 shows a polishing attachment for use with the device of FIG. 1.
Figure 3:
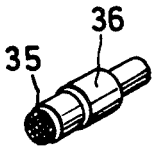

In order to polish a fingernail the cylindrical abrasive-stone is replaced by the polishing means shown in FIG. 3. This can then be applied against the finternail to polish or buff it.

In all the above uses of the preferred manicure device, the rotation of the shaft may be either fast or slow, as determined by the position of the switch 8, so as to produce the desired effect most efficiently.

I claim:

1. A portable battery operated manicure device comprising a casing adapted to receive at least one electric battery, a motor mounted in said casing and having a rotatable drive shaft extending axially of said motor, said shaft extending through said casing and having first and second ends projecting outwardly from said casing, electrical connection means including switch means mounted on said casing and operatively connecting said motor to a battery received within said casing, an abrasive disc frictionally mounted on said one end of said drive shaft externally of said casing, a first sleeve means secured to said casing and peripherally surrounding said abrasive disc, said first sleeve means including a stationary protective ring spaced slightly from said disc for protective engagement by the skin of a finger to prevent contact thereof with said abrasive disc yet permitting the fingernail of said finger to protrude toward said abrasive disc for operative engagement therewith.

2. A portable battery operated manicure device as set forth in claim 1, wherein there is provided a cylindrical abrasive stone with holder, a centrifugal fan, and second sleeve means having an aperture, said abrasive-stone with holder and said fan being mounted on said second end of said shaft, said second sleeve means being secured to said casing and surrounding said fan and at least partially said abrasive-stone with holder, and said aperture being adjacent said fan whereby said second sleeve means provide a rest for a finger whose nail is in contact with said abrasive stone.

3. A portable battery operated manicure device as set forth in claim 2, wherein said second sleeve means includes a wide portion and a narrow portion, said wide portion surrounding said fan, said narrow portion at least partially surrounding said abrasive-stone with holder, and said second sleeve means being detachable from said casing.

4. A portable battery operated manicure device as set forth in claim 1, wherein a polishing head with holder is friction mounted axially on said second end of said shaft, said polishing head being detachable from said holder.

5. A portable battery operated manicure device as set forth in claim 1, wherein a notched disc is friction mounted axially on said second end of said shaft.

* * * * *